US006685605B1

(12) United States Patent
Klossner

(10) Patent No.: US 6,685,605 B1
(45) Date of Patent: Feb. 3, 2004

(54) EXERCISE APPARATUS FOR THE LIMBS AND JOINTS

(75) Inventor: Carl H. Klossner, Rome, NY (US)

(73) Assignees: Mark A Klossner, Verona, NY (US); Christine A. Klossner, Rome, NY (US); Kevin C. Klossner, Oneida, NY (US)

( * ) Notice: Subject to any disclaimer, the term of this patent is extended or adjusted under 35 U.S.C. 154(b) by 138 days.

(21) Appl. No.: 09/699,701

(22) Filed: Oct. 30, 2000

(51) Int. Cl.[7] ..... A63B 26/00

(52) U.S. Cl. ..... 482/142; 482/908; 601/23; 601/51; 601/32

(58) Field of Search ..... 482/142, 148, 482/908; 601/23–32, 51; 600/26; 5/1, 2.1, 11, 27, 37.1, 600–624, 81.1 R, 83.1, 85.1, 87.1, 88.1, 86.1, 84.1, 89.1, 81.1 C, 81.1 RP, 81.1 HS, 81.1 T

(56) References Cited

U.S. PATENT DOCUMENTS

| | | | | | |
|---|---|---|---|---|---|
| 1,612,496 | A | * | 12/1926 | Dobbins | |
| 2,262,271 | A | * | 11/1941 | DeCamp | 482/142 |
| 2,570,676 | A | * | 10/1951 | Henderson | 128/33 |
| 2,869,539 | A | * | 1/1959 | Mosse | 482/142 |
| 2,895,468 | A | | 7/1959 | Short | 128/33 |
| 2,928,675 | A | * | 3/1960 | Nawara | |
| 3,882,556 | A | | 5/1975 | Accurso | |
| 4,175,550 | A | | 11/1979 | Leininger et al. | 128/24 |
| 4,258,446 | A | | 3/1981 | McAllister et al. | |
| 4,582,050 | A | | 4/1986 | Willis | 128/73 |
| 4,586,492 | A | * | 5/1986 | Manahan | 128/33 |
| 4,634,118 | A | * | 1/1987 | Jensen | 272/117 |
| 4,868,937 | A | | 9/1989 | Connolly | 5/61 |
| 4,958,627 | A | | 9/1990 | Park | 128/33 |
| 5,066,005 | A | * | 11/1991 | Luecke | 272/136 |
| 5,151,931 | A | | 9/1992 | Terashi et al. | 378/65 |
| 5,181,288 | A | | 1/1993 | Heaton et al. | 5/607 |
| 5,501,656 | A | * | 3/1996 | Homma et al. | 482/69 |
| 5,820,519 | A | * | 10/1998 | Slenker | 482/127 |
| 6,108,838 | A | | 8/2000 | Connolly et al. | 5/609 |
| 6,112,349 | A | | 9/2000 | Connolly | 5/607 |
| 6,113,563 | A | * | 9/2000 | D'Amico et al. | 602/32 |

* cited by examiner

*Primary Examiner*—Nicholas D. Lucchesi
*Assistant Examiner*—L Amerson

(57) ABSTRACT

A reciprocating bed as a one size fits all from small children to the tallest of people by adjusting, and a frame designed to accommodate anyone regardless of weight that reciprocates approximately four times a minute per cycle of reciprocation. This bed can exercise any limb or joint of the body and up to 5 limbs per cycle of reciprocation and also a mobile unit with wheels to be located anywhere with a frame that can be assembled and disassembled with little effort and also can be enclosed with curtains for privacy and also an appealing piece of furniture. Other features are two models with one of manual controls and one fully automatic as a purchaser can purchase a manual model more affordable for anyone and a fully automatic with controls that can be operated by the recipient, and if a purchaser does purchase a manual model, they can update the same frame with automatic controls using the interchangeable pre-drilled mounting plates as either controls will operate consistantly with one another with one or up to five of either as affordability prevails and also capable of operating 24 hours a day, seven days a week.

1 Claim, 12 Drawing Sheets

EXERCISE APPARATUS FOR THE LIMBS AND JOINTS

CROSS-REFERENCE TO RELATED APPLICATIONS

Figure 1:
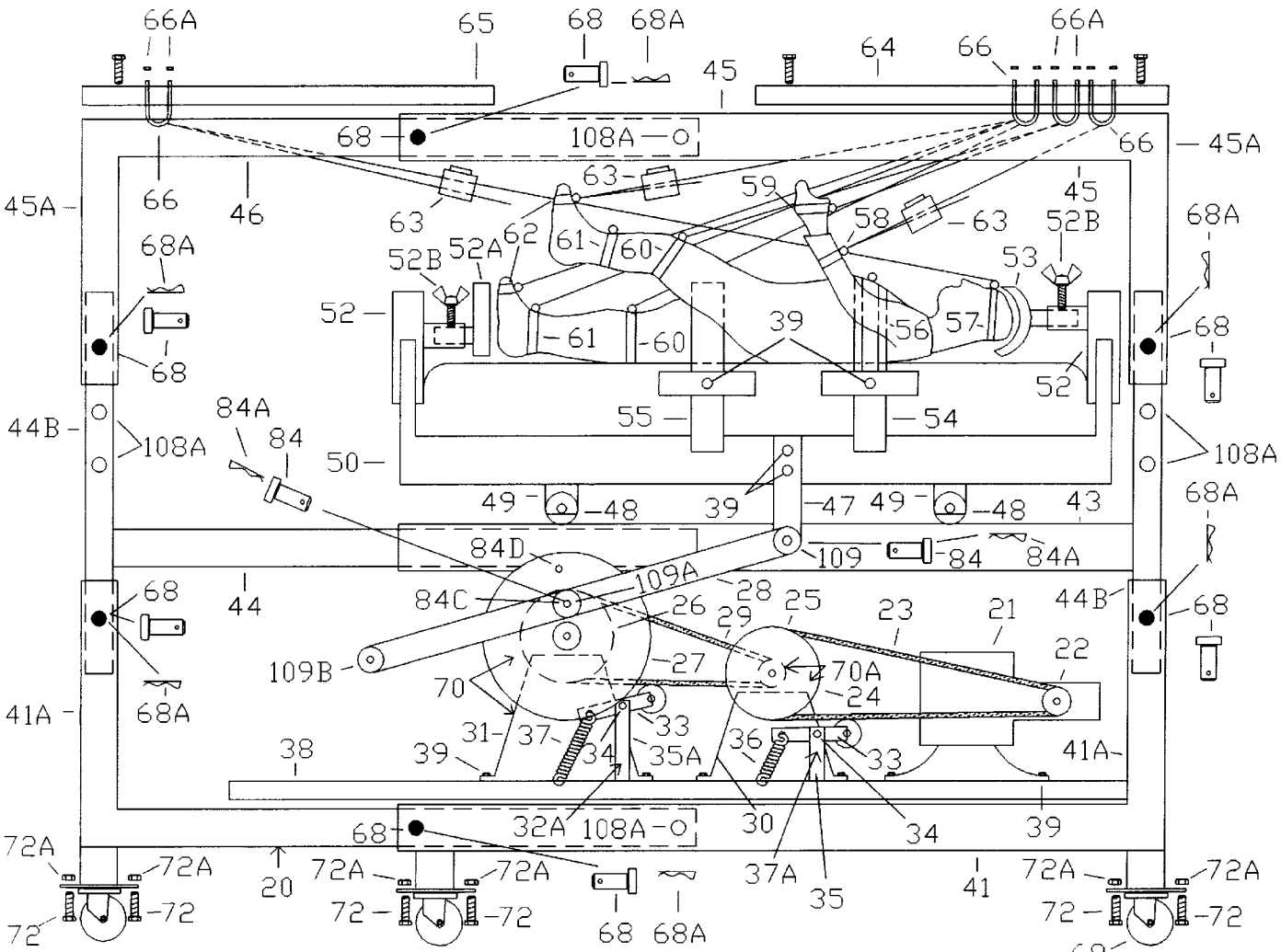

The following references relating to the following patents to the present invention are explained in the background art section, (e), (2) are; U.S. Pat. No. 5,113,563 D'Amico 9-2000, U.S. Pat. No. 2,570,676 Henderson 12-1950, U.S. Pat. No. 4,175,550 Leininger 11-1979, U.S. Pat. No. 4,586,492 Manahan 5-1986, U.S. Pat. No. 4,582,050 Willis 4-1986, U.S. Pat. No. 4,958,627 Park 9-1990, U.S. Pat. No. 2,895,468 Short 7-1959, U.S. Pat. No. 5,151,931 Terashi 9-1992, U.S. Pat. No. 4,868,937 Connolly 9-1989, U.S. Pat. No. 6,112,349 Connolly 9-2000, U.S. Pat. No. 6,108,838 Connolly 8-2000, U.S. Pat. No. 5,181,288 Heaton 1-1993.

STATEMENT REGARDING FEDERALLY SPONSORED RESEARCH AND DEVELOPMENT

"Not Applicable"

INCORPORATION-BY-REFERENCE OF MATERIAL SUBMITTED ON A COMPACT DISC

"Not Applicable"

REFERENCE TO A "MICROFICHE APPENDIX"

"Not Applicable"

BACKGROUND OF THE INVENTION (1) Field of the Invention

The present invention is designed for therapy and exercise to any limb or joint of the human body, capable of exercising up to five limbs per cycle of reciprocation, twenty four hours a day, seven days a week if desired. Also importantly, this invention can be a recipients personal bed in homes, hospitals, or wherever, as it is also a mobile unit and can be controlled by the recipient. The need for millions of people the world over that exercise is the most important activity in daily life, this present invention is capable of opening the doors of hope to those bedridden with no escape of a better life. This invention is a one size fits all bed that can accompany any type mattress of your choice, soft, hard, air, water, or whatever to give the comforts preferred. This invention is a gentle horizontal reciprocating motion, when a recipient lying in a supine position, will produce the most therapy relaxing effect possible and if recipient decides to exercise any body limbs and joints while awake or sleeping, attaching belt straps to any limb, can operate the bed either manually or automatically, as two models with interchangeable controls used on the same bed frame for the reason, if manual controls are purchased with the bed frame, a recipient can update the original bed frame with automatic controls.

This present invention was designed as a one size fits all bed that will accommodate anyone from small children to the tallest of people by using an adjustable bed frame that will interchange two length frames. Also, this frame can accommodate anyone regardless of weight, which makes this unique frame a possible future bed of the world, as anyone regardless of their health status, could enjoy. An example of this inventions capabilities, say for example, twelve of these exercise beds in a hospital ward, recipients could be exercising their body limbs and joints or just reciprocating just for relaxation with a curtain enclosure for privacy, and could be reading a book or whatever instead of lying in a hospital bed depressed.

Researches has been made by professors with articles made known that millions of people with afflicting diseases such as, muscular dystrophy, diabetes, down syndrome, arthritus, paraphalegics, and many others, that exercise is the most important part of the bodies needs. Another important feature is, most people can't afford therapy exercise everyday, and those that can afford to go, has to go to a therapy room with needs of assistance to get to therapy locations, and are fortunate if they receive one hour a day of therapy compared to twenty four hours a day, seven days a week, thus the reason for designing this invention. Other reasons are, a working model was built to prove the unique features that any body limb and joint can be exercised, and to produce the important speed of reciprocation and power with gear boxes to perform the functions.

To realize the authenticity of this invention, for example, a bedridden or incapacitated recipient lying in a normal bed and never moving, in comparison, that once an assistant attaches the lifting straps to any and up to five limbs can be raised and lowered per cycle of reciprocation, many of these recipients can operate this procedure for as long as desired, and enjoy a new lease on life, and many recipients may be able to walk again with the constant use of movement to strengthen the body joints and muscles, and decrease the spasticity according to professors from universities, have noted that retraining victims with paralized limbs can be retrained to walk. This factor in conjunction with this invention is very important that the body limbs can be exercised as long as necessary rather than one hour a day, by having a bed with a recipient in a supine position for comfort and rest while exercising, thus a therapy relaxing effect and no strain on the heart.

(2) Description of the Related Art Including Information Under 37 CFR 1.97 and 37 CFR 1.98

Other types of devices performing therapy and exercise to partial sections of the body, such as U.S. Pat. No. 6,113,563 to D'Amico, concentrates on the neck in a traction device, with the recipient or assistant controlling weights, must be extremely aware of the pressure applied to the neck and spine, as human error can result in injury, whereas in comparison to the present invention with power driven controls that is always in the boundries of natural movement, as a complete cycle of reciprocation is always the same, even when adjusting the belt straps to any height of raising and lowering the limbs to any height. U.S. Pat. No. 2,570,676 Henderson, with a reciprocating bed that moves sideways rather than lengthwise, as this present device performs movement to the limbs, Henderson's device could not perform this operation. Other examples of therapy exercise devices, relates more to traction and are more related to therapy locations rather than a mobile unit of this present device that isn't limited to any specific location. U.S. Pat. No. 4,175,550 Leininger, U.S. Pat. No. 4,586,492 Manahan, U.S. Pat. No. 4,582,050 Willis, U.S. Pat. No. 4,958,627 Park, U.S. Pat. No. 2,895,468 Short, U.S. Pat. No. 5,151,931 Terashi, U.S. Pat. No. 4,868,937 Connolly, U.S. Pat. No. 6,112,349 Connolly, U.S. Pat. No. 6,108,838 Connolly, U.S. Pat. No. 5,181,288 Heaton.

Thus it would be beneficial to provide a mobile unit to perform a therapy exercising device in any location with minimal or no assistance needed, that can exercise any body limb with a gentle therapy relaxation, in a atmosphere of privacy if desired, in hospitals or wherever, with an appealing enclosure, and at the same time, strengthen the limbs, joints, muscles, and possibly the heart due to this present device that can be a recipients personal bed on a every day basis in any environment.

BRIEF SUMMARY OF THE INVENTION

The present advantages is designed as a one size fits all bed with a unique adjustable bed frame to accommodate anyone from small children to the tallest of people, and can also accomodate anyone regardless of weight. This device reciprocates, creating a gentle therapy relaxation, and at the same time can exercise any limb or joint of the body and up to five limbs per cycle of reciprocation, with a movement of approximately 4 cycles per minute. Other advantages are, this device is a self-contained mobile unit that can be used in homes, hospitals, or wherever, and can be enjoyed by anyone, regardless of their health status, as exercise to the limbs and joints are very important for anyone. The most important background for designing and building a working model, to prove it's authenticity. Their are millions of people the world over that are afflicted with degenerative diseases such as muscular dystrophy, down syndrome, arthritus, paraphalegics, and many others. Articles by professors of renowned universities, quote the importance of exercise, and this device pertains exactly to these articles. As their are millions of people who can't afford assistance, and those that can, therapy and exercise are limited to appointments, and a certain amount of time a day. Thus this present invention is capable of performing therapy and exercise twenty four hours a day, seven days a week if desired, and be a recipients personal bed while enjoying the luxuries of exercise and therapy relaxation at their fingertips. This could possibly eliminate therapy rooms for the movement of the limbs. Also, this present invention would be beneficial to many of those bedridden and incapacitated and will continue getting worse without exercise. According to articles by professors of universities, if recipients could receive exercise on a daily basis, chances of strengthening the muscles and joints, and possibly the heart for many by improving circulation, would be a tremendous accomplishment.

In conclusion, this present invention as stated, is a one size fits all, capable of exercising all the body limbs and joints at a very low cost, for the reason of gear box motors for energizing the drive trains, and lifting and lowering the limbs, could become a tremendous impack to millions of people.

BRIEF DESCRIPTION OF THE SEVERAL VIEWS OF THE DRAWING'S

Drg. 1 shows a complete bed unit of normal size.

Drg. 2 shows a complete oversize bed unit.

Drg. 3 shows a bottom base frame with swivel wheels.

Drg. 4 shows a center base frame with wheel and bed guide tracks.

Drg. 5 shows a top base frame.

Drg. 6 shows a normal size bed frame.

Drg. 7 shows a oversize bed frame.

Drg. 8 shows the drive trains with components, a on off switch, a timer control, and a push button control.

Drg. 9 shows predrilled mounting plates with interchangeable u-bolts and motors.

Drg. 10 shows the undercarriage of the bed frame.

Drg. 11 shows a complete bed unit with an enclosure.

Drg. 12 shows a bed rail and bed frame enclosure.

DETAILED DESCRIPTION OF THE INVENTION

Amendment to the Specification

Figure 2:
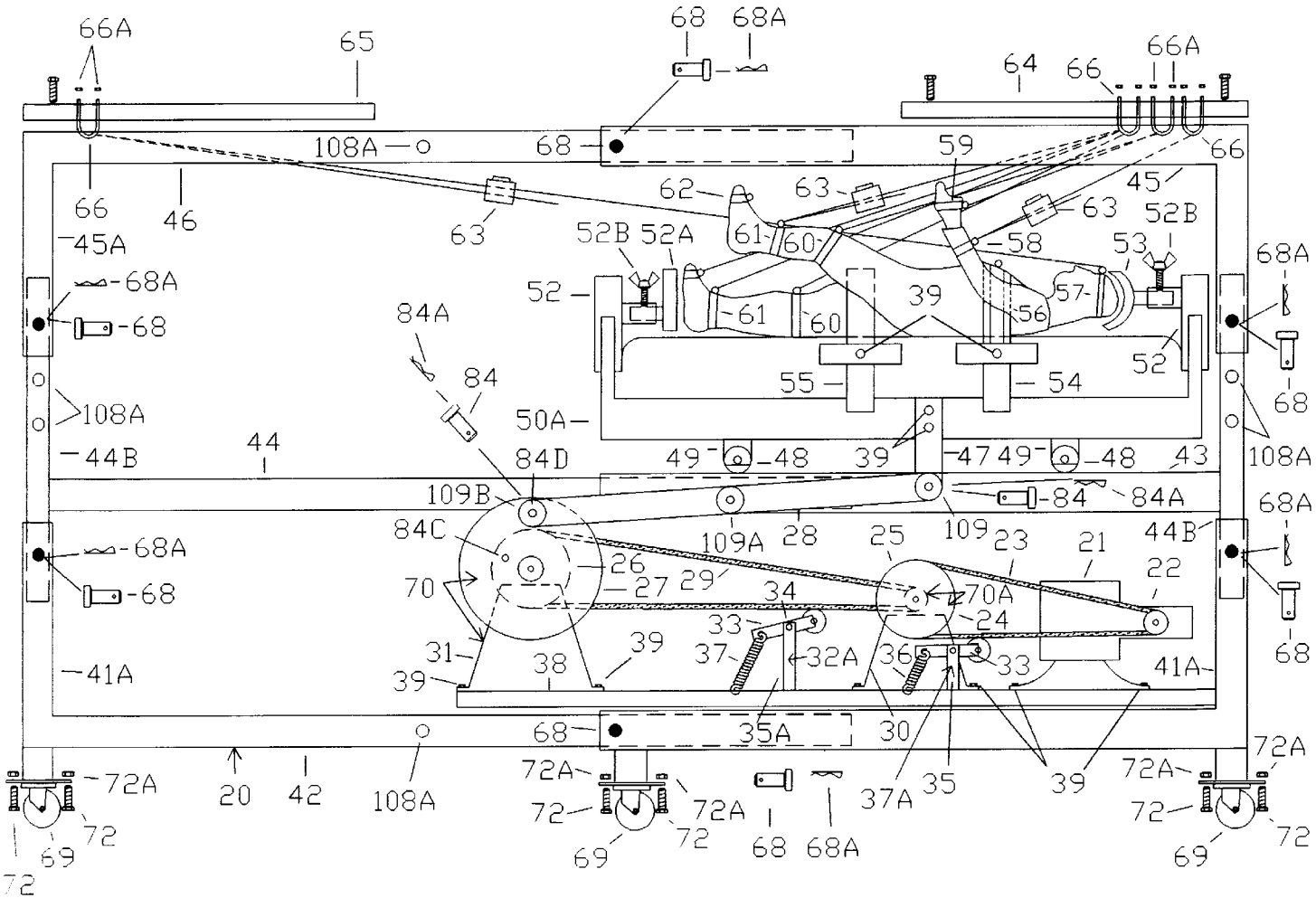
Figure 3:
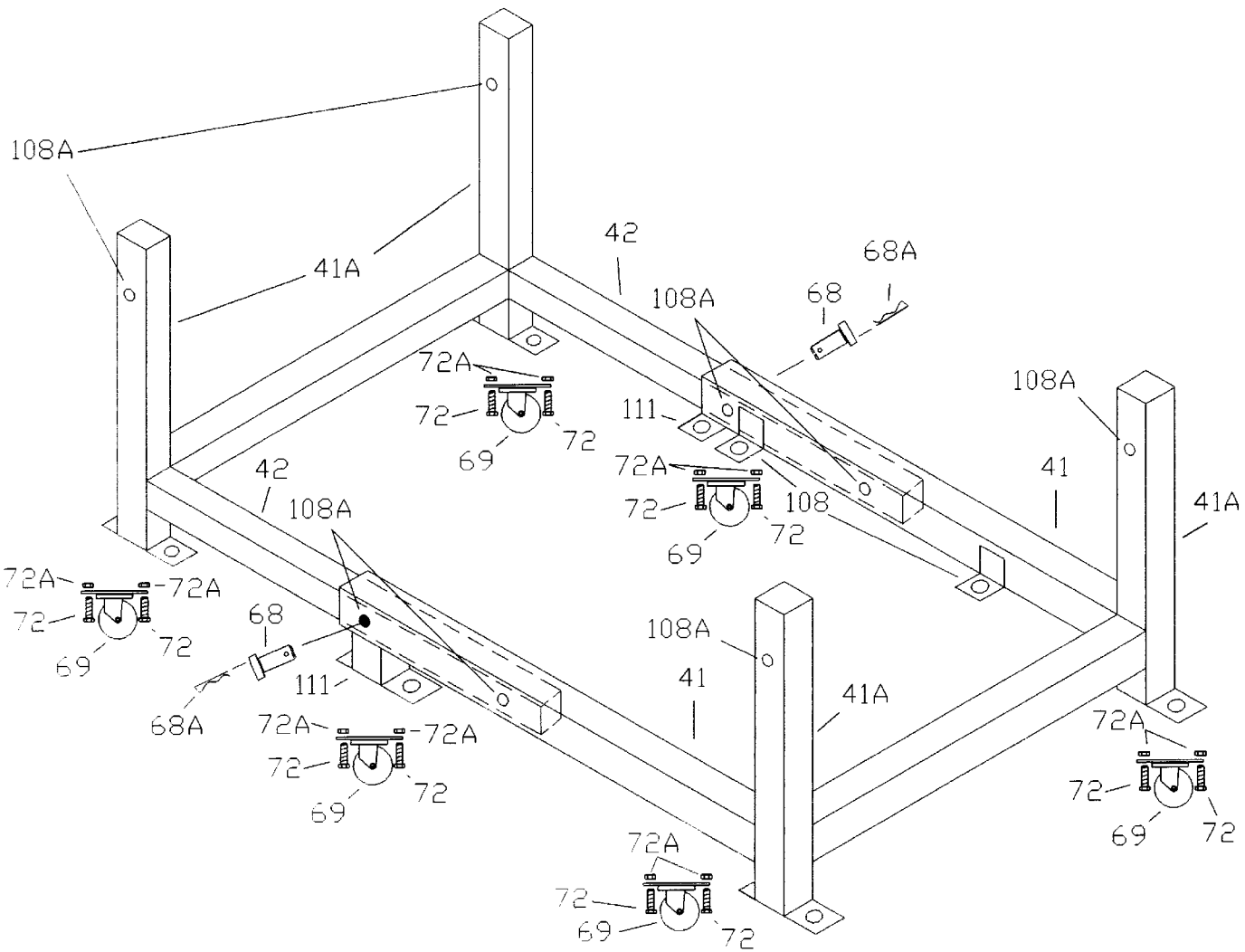
Figure 4:
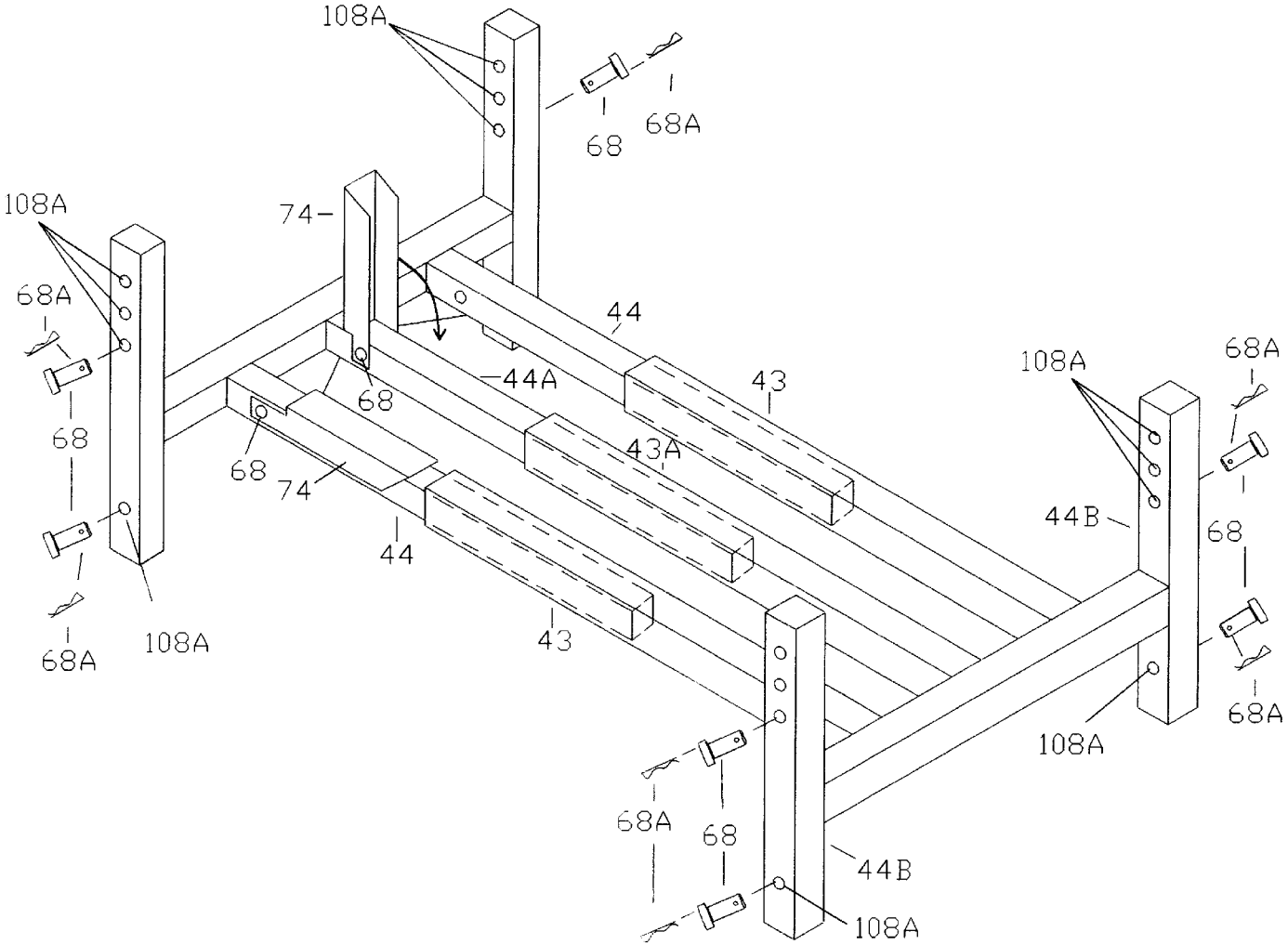
Figure 5:
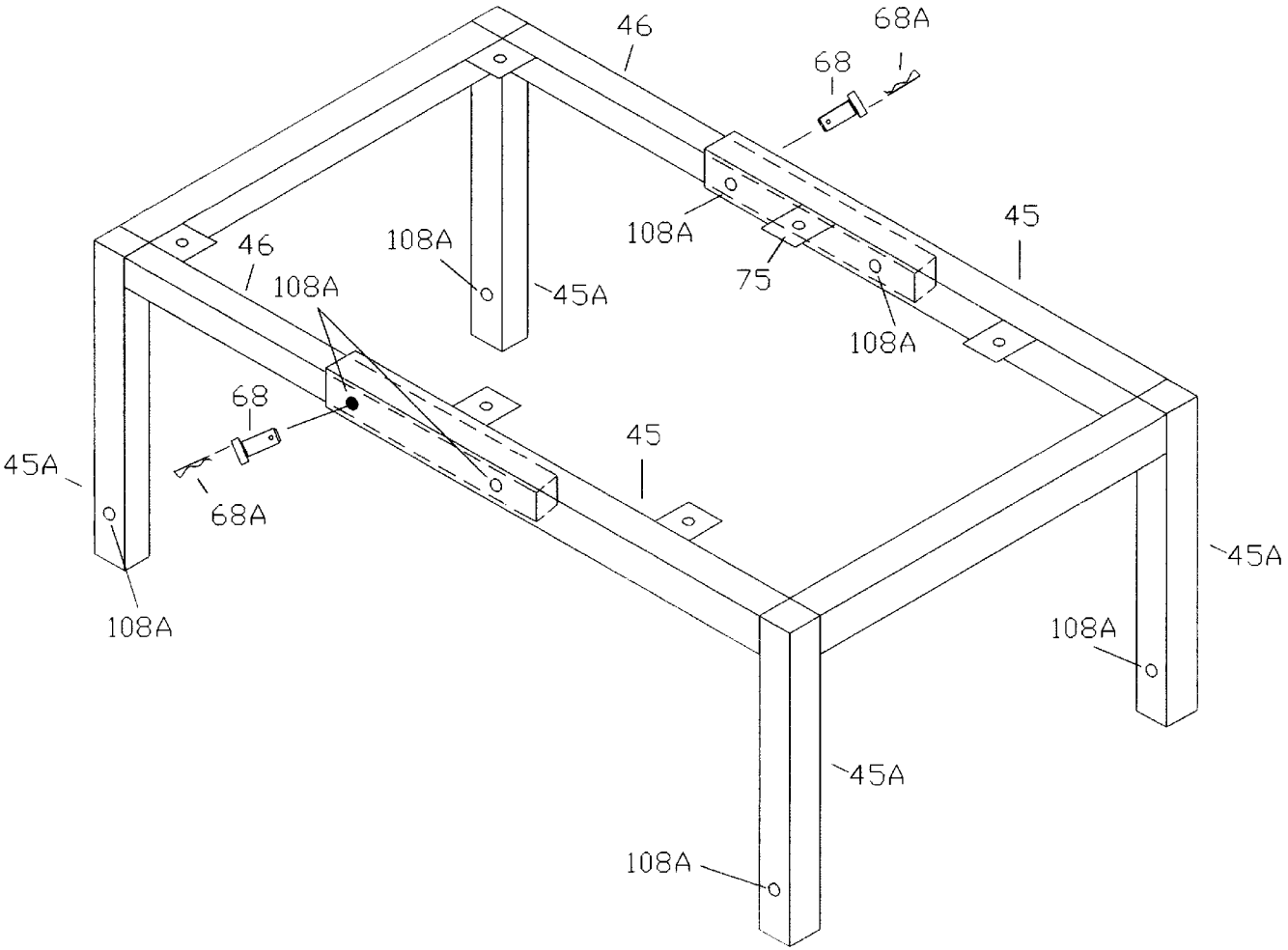
Figure 6:
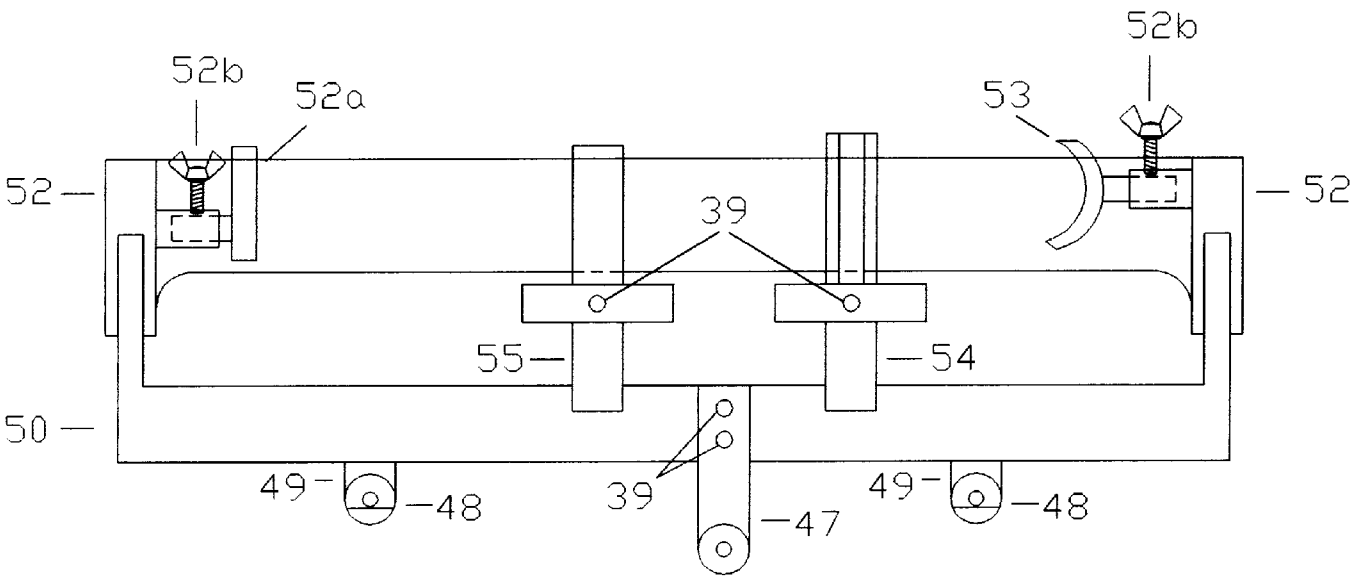

Referring to FIGS. 3, 4, 5 comprising of six sectional frames 41, 43, 43*a*, 45 with corner posts 41*a*, 45*a* denotes a larger diameter size tubing. Referring to frames 42, 44, 44*a*, 46 with corner posts 44*b* denotes a smaller size tubing. Frames 41, 43, 43*a*, 45 with corner posts 41*a*, 45*a* denotes telescoping within another and signifies a complete base frame 20. Referring to swivel sheels 69 secured to frame FIG. 1 with bolts 72 and nuts 72*a*, brackets 108 secured to frame 41 and signifies weight of recipient using bed frames FIGS. 1, 2 will prevent frames 41, 42 from sagging or binding. Referring to FIGS. 1, 2, frame sections 41–46 is assembled and secured with shaded pins 68 and keys 68*a* inserted in holes 108*a* secures frame 20. Removing pins 68 and keys 68*a* and telescoping frames 41–46 to the required alignment holes denotes adjusting frame 20. Refer to a pre-drilled mounting plate 38 FIG. 2 denotes repositioning drive train 70 and denotes changing the length of reciprocation for two different length frames 50–50*a*. The plate 38 is secured to brackets 108 and holes 89.

Figure 7:
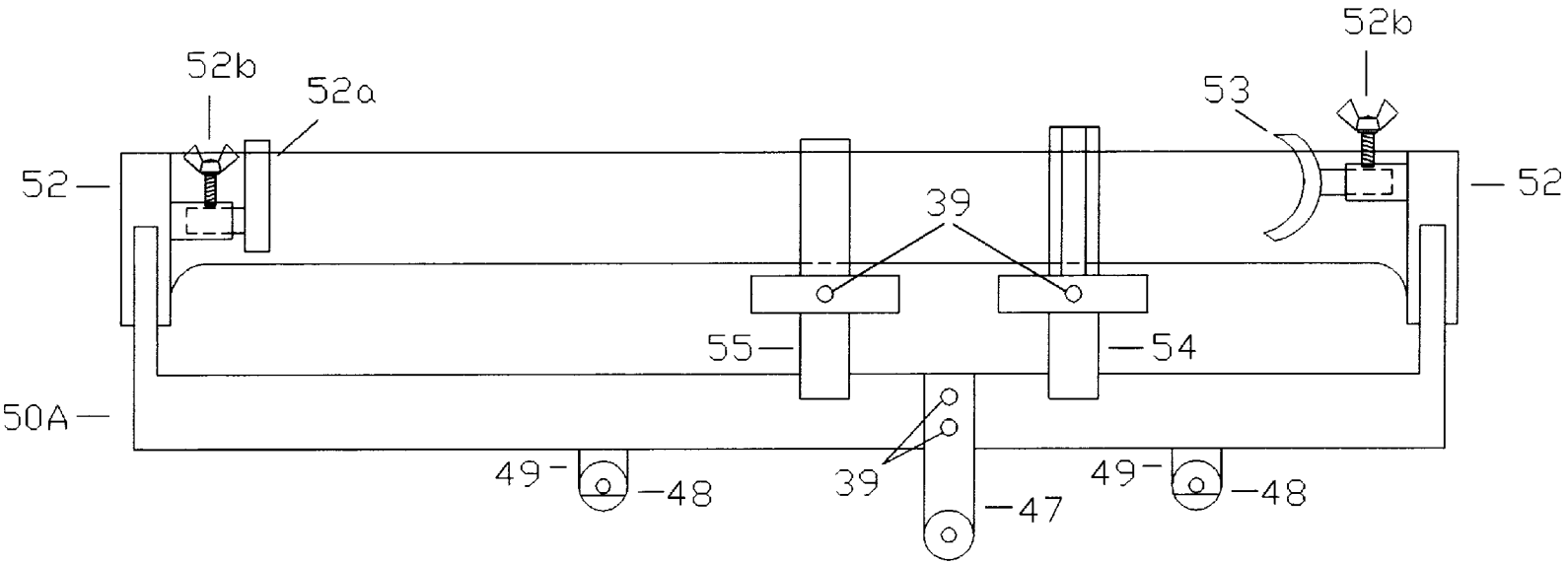
Figure 8:
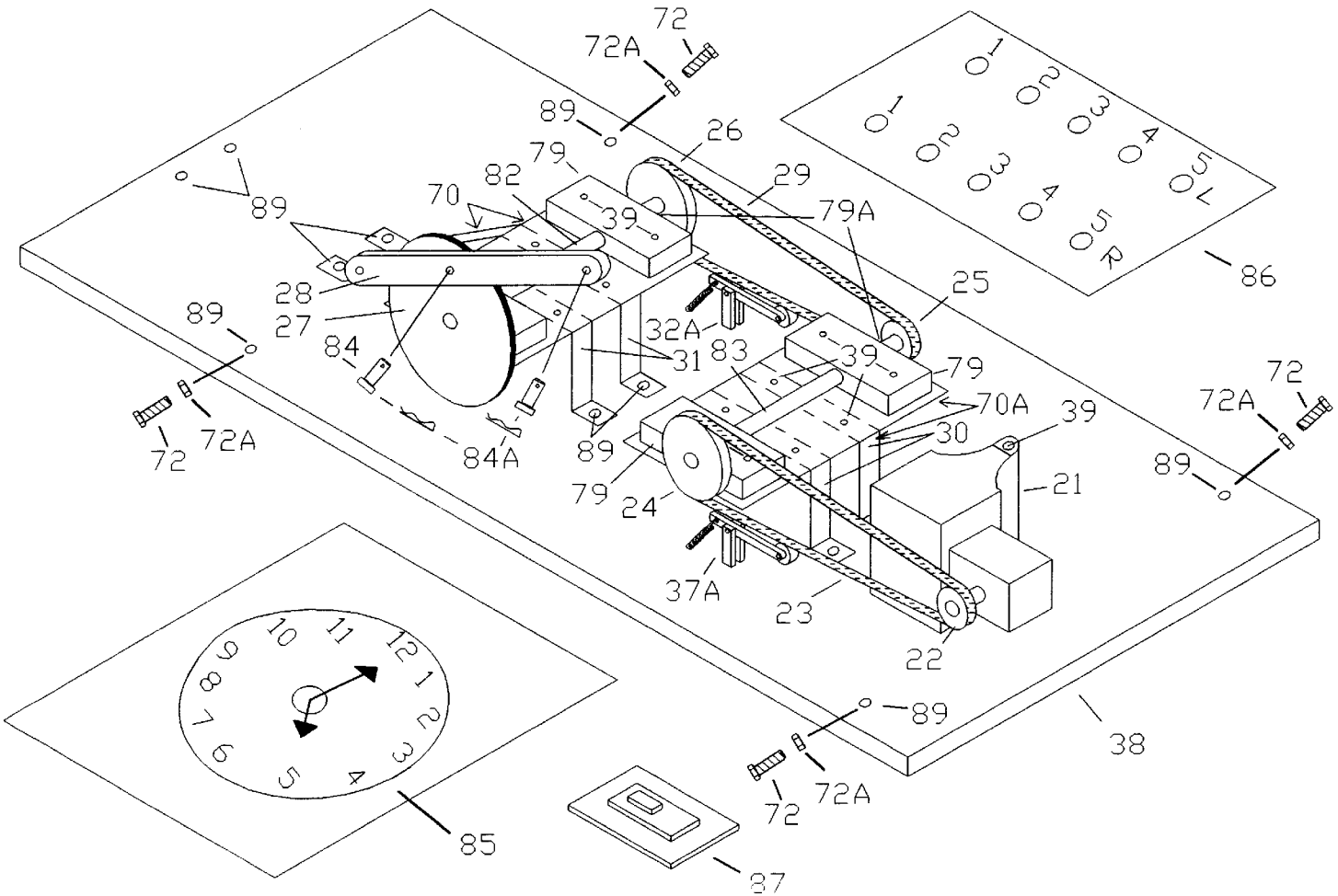
Figure 9:
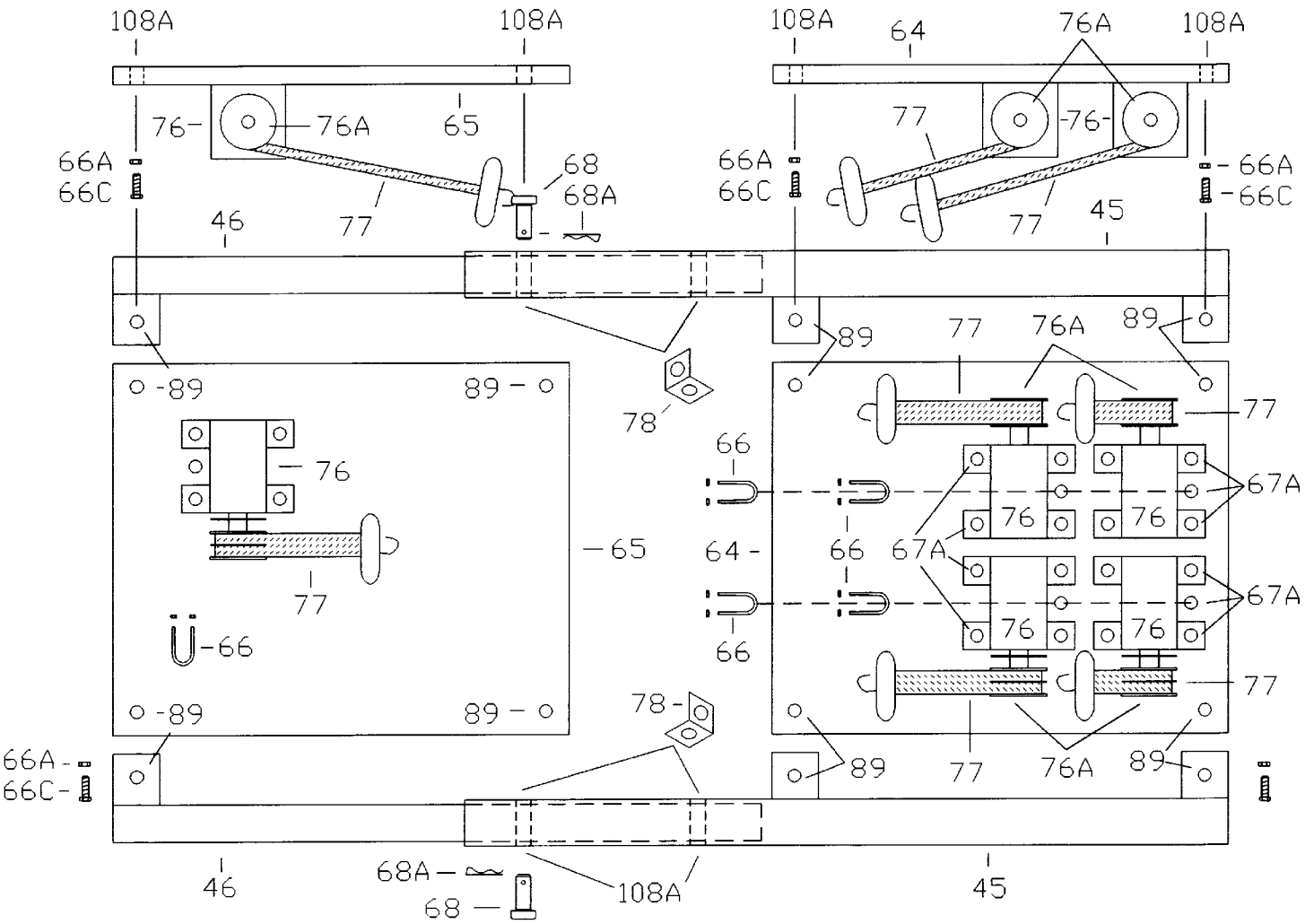

Referring to FIG. 9 repositioning L brackets 78 denotes repostioining the length of frame 20 and plate 65 with nuts 66*a* and bolts 66*c* and denotes a fixed attachment when repositioning plate 65. Referring to power components for reciprocating frames 50–50*a* FIG. 1 denotes a gear box motor 21 and drive pulley 22 which turns belt 23. To prevent belts from slipping on pulley's, self adjustment assemblies 32*a*, 37*a* when motor is energized, pressure is applied to belts by means of pivot arms 33 secured with pins 34 attached to tension springs 36, 37 secured to support arms 35, 35*a*. The drive pulley 25 turns belt 29 to reduction pulley 26 that turns crank wheel 27. A view of two drive train assemblies 70, 70*a* FIGS. 1, 2 show the required length of reciprocation. The normal size frame 50 attached to crank wheel hole 84*c* and bearing hole 109*a* to arm 47 and arm bearing 109, secured to pins 84 and keys 84*a*. When the longer distance of reciprocation is required for taller recipients, frame 50*a* FIG. 7 means replacing frame 50. Referring to FIG. 2 is the longer distance of reciprocation, by repositioning train assembly denotes predrilled holes 89 in plate 38, FIG. 8 and using belt 29. The arm 28 secured to wheel hole 84*d* to bearing hole 109*b*. The arm bearing 109 in arm 28 secured with pins 84 and keys 84*a*. Referring to components of 70*a* FIG. 8, support brackets 30 denotes securing pillow blocks 79 and bearings 79*a* with bolts 39. Inserting shaft thru bearings 79*a* with pulley's 24, 25 to each end of shaft, denotes turning belt 29 and pulley 26. Referring to train 70 is identical to components in 70*a* except brackets 31 are longer, denotes clearance of undercarriage of frames 50–50*a*. Referring to belt supports 56–62 denotes belt attachments to the body limbs to manually adjustable buckles 63 to u-bolts 66 secured to predrilled mounting plates 64–65 denotes interchangeable holes 67*a* FIG. 9 which indicates securing either u-bolts 66 or automatically controled forward-reverse motors 76. with belt wheels 76*a* and belts 77 which signifies automatically lifting and lowering the body limbs by means of a motor control 86 FIG. 8. Also a timer control 85 denotes energizing frames 50–50*a* at any given time and a off-on switch 87 to overide all electrical controls.

Figure 10:
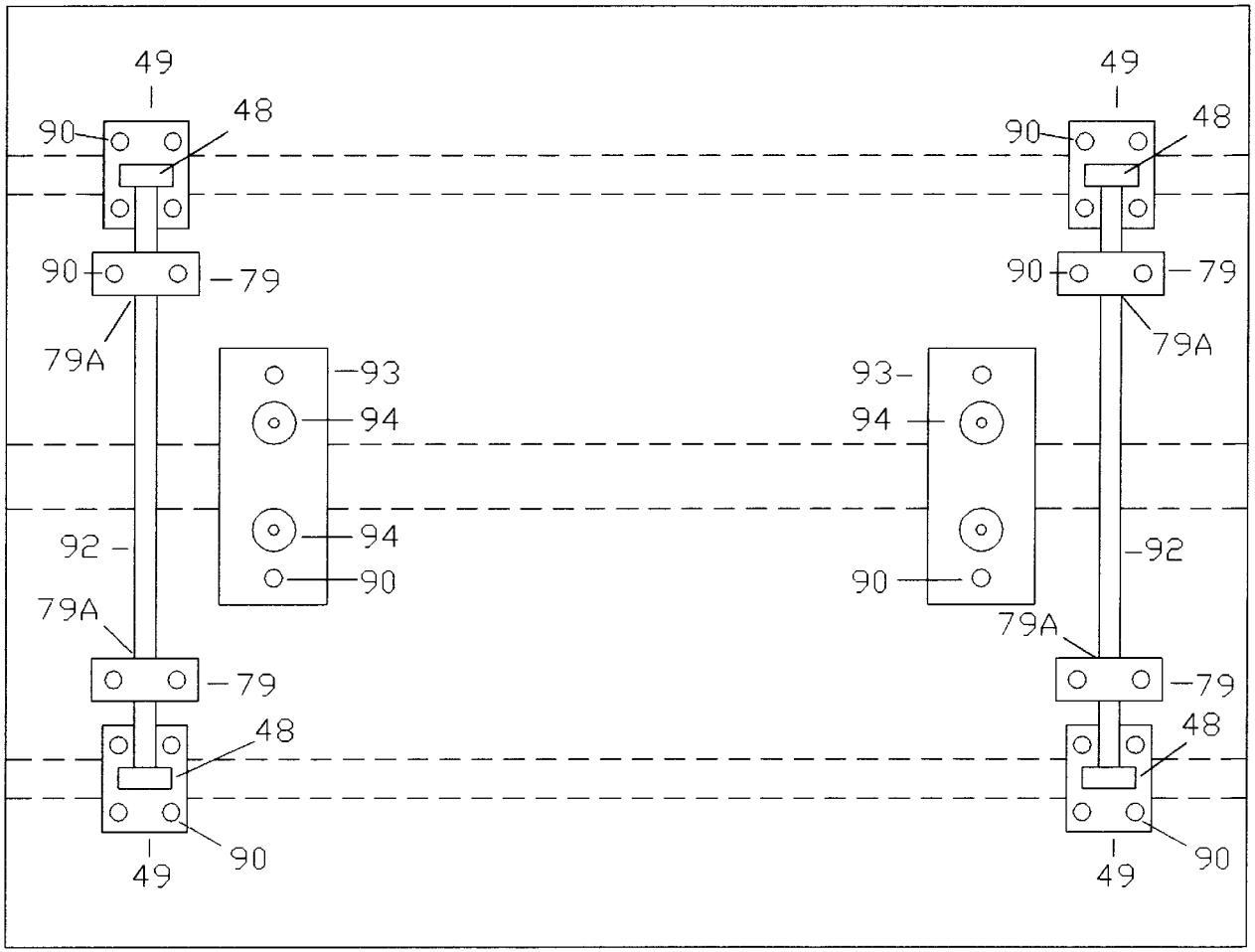

Referring to foot and head supports 52 FIGS. 1, 2 secured to frames 50–50*a* with foot support 52*a* and head support 53 denotes adjusting to the length of recipients body and secured with wing. bolts 52*b*. The upper and lower body belts 54, 55 means assisting foot supports 52*a* and head supports 53 for recipients incapable of supporting their body or extremely heavy recipients from sliding in the direction of the lifting motion. Referring to channel brackets 74 FIG. 4 when hinged down over frames 44, 44*b* frames 43, 43*a* will be identical, which means the longer frame 50*a* with wheels 48 secured to brackets 49 FIG. 10 will reciprocate the longer distance required. Also FIG. 10, the undercarriage of frames 50–50*a* with pillow blocks 79 and bearings 79*a* and shafts 92 turns wheels 48 on tracks 44.

Figure 11:
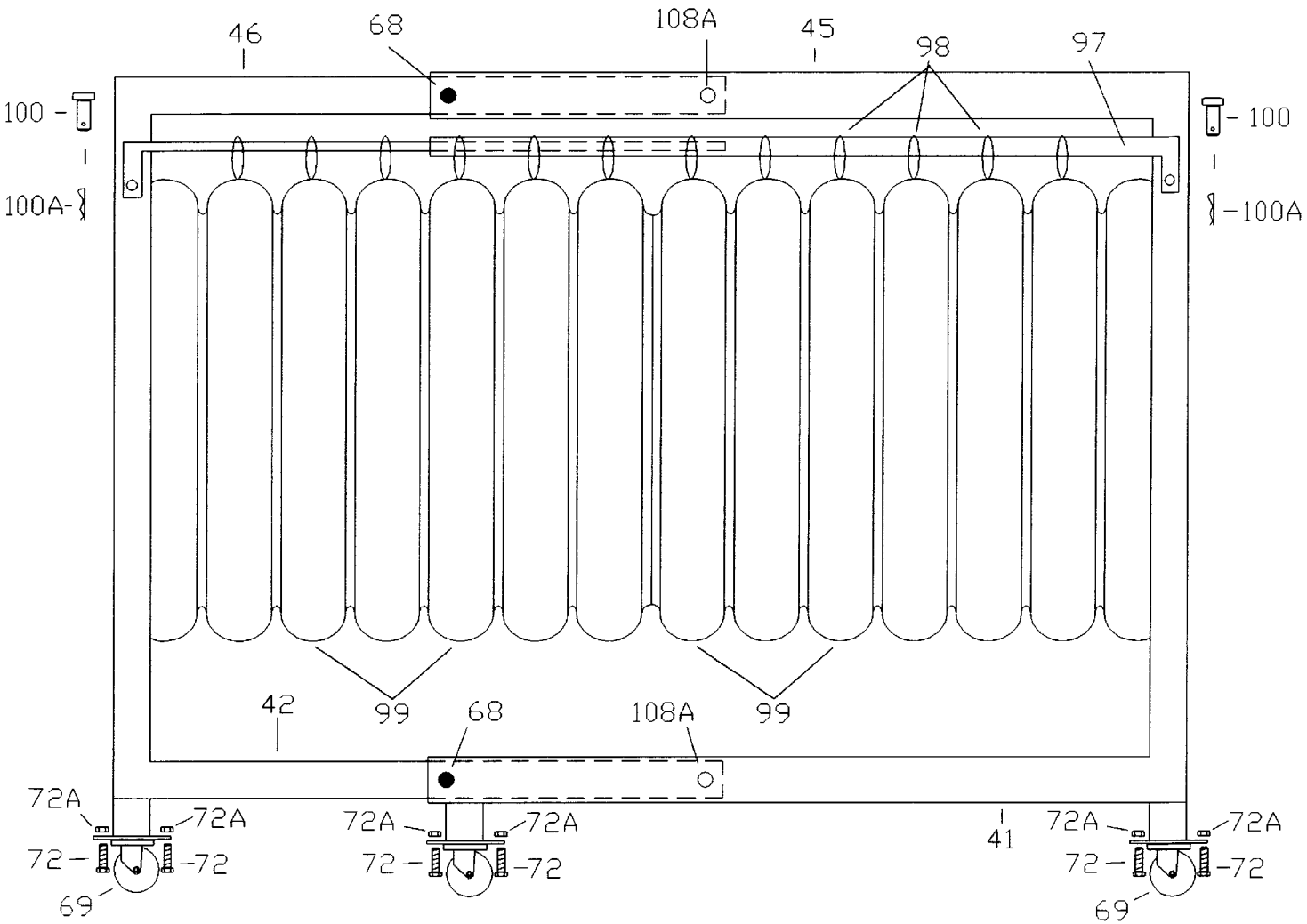
Figure 12:
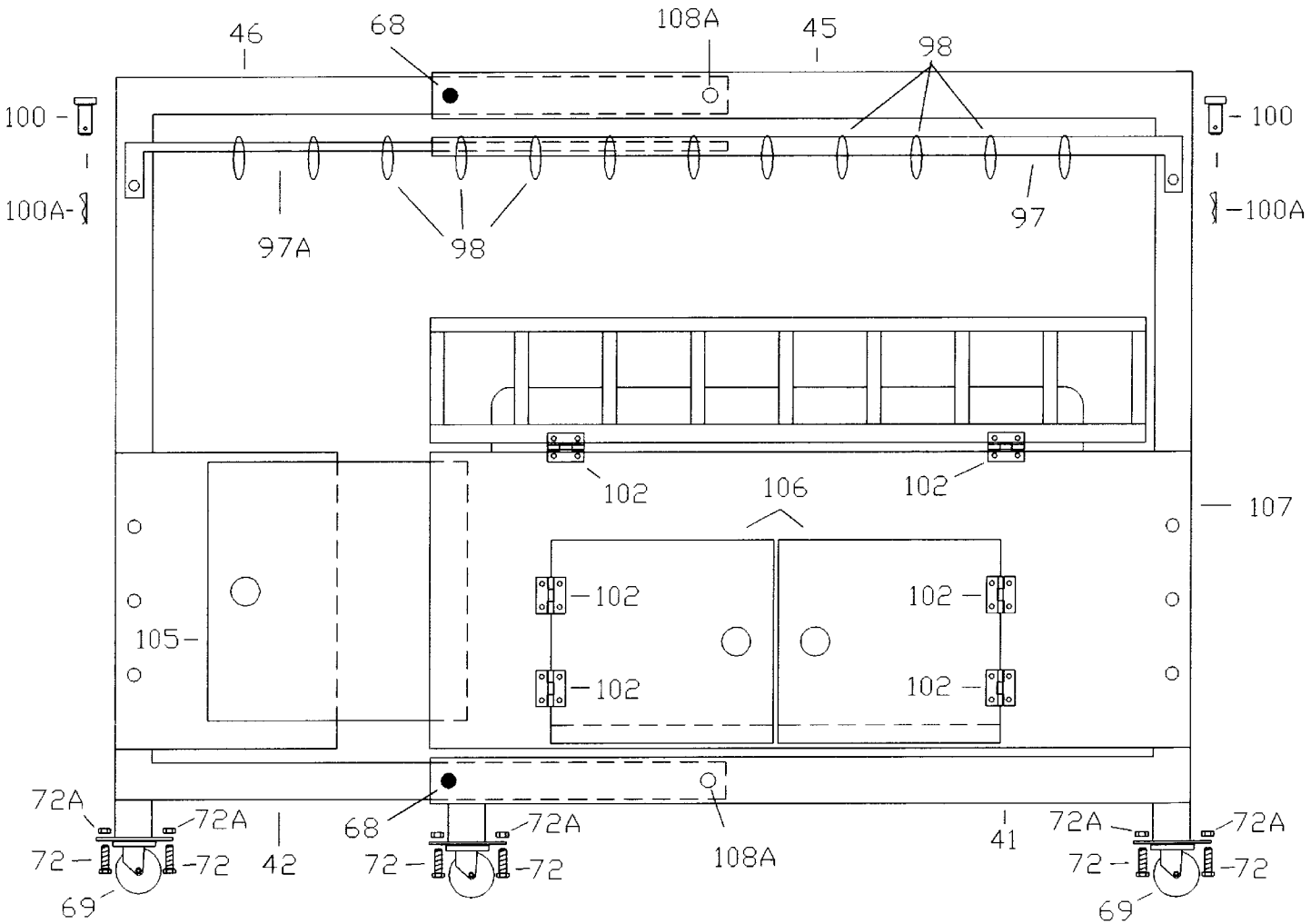

Referring to brackets 93, secured to holes 90 with guide track wheels 94 denotes frames 50–50*a* will stay in alignment when reciprocating on frame tracks 43, 44 with guide frame tracks 43*a*, 44*a* FIG. 4. Referring to FIG. 11, an enclosed frame 20 with curtains for privacy with adjustable rods 97, 97*a* and rings 98 to adjust to frame 20. Referring to FIG. 12 to bed frames with hinges 102 for recipients with incapabilities. An adjustable door 105 to adjust with frame 20. Enclosure frames 104, 107 with doors 105, 106 denotes access to the operational section of driving mechanism. While certain features of this invention have been shown, described, and pointed out the annexed claims, it will be understood that various omissions, substitutions and changes in the forms and details of the device illustrated and its operation can be made by those skilled in the art without departing from the spirit of the operation.

What is claimed:

1. A reciprocating exercise bed designed for therapy relaxation and exercise for the human body limbs and joints comprising:

the reciprocating exercise bed adapted for exercising up to five body limbs per cycle with a horizontal reciprocating motion of four cycles per minute;

a plurality of telescoping sectional frames, each said frame consisting of a bottom, center, and top whereby when all said frames are assembled together comprises a bed frame, said bed frame adjustable and affixed with a locking device so that a user of any length, when lying in a supine position, can comfortably adjust said bed frame;

the bottom frame having a plurality of swivel wheels;

the center frame including at least one wheel and a plurality of bed guide tracks;

a gear reduction drive motor component and a drive train component, said drive train comprising an assembly of components including an on/off switch, a timer control, and a push button control for the purpose of assisting related components in creating a reciprocating movement; and further including self-adjustment belt assemblies for reciprocation when said center sectional frames are telescoped within said bottom frame, said gear reduction drive motor, said drive train and said belt assembly secured to said bottom sectional frame;

a predrilled mounting plate component having a plurality of alignment holes attached to said bottom sectional frame for repositioning said drive train whereby changing the length of reciprocation and length of said bed frames in order to accommodate a different sized user, lying in a supine position, while exercising body limbs and joints on said center sectional frame;

a crank wheel component affixed to said repositioned drive train, said crank wheel having eccentric dimensional holes in the center of said wheel, said crank wheel facilitates driving a plurality of different length frames which creates a back and forth reciprocation, said drive train having a drive arm with dimensional holes that change the length of said arm, said arm is affixed to said eccentric hole in said crank wheel which enables one end of the arm to reciprocate, said one end of said arm having a bearing hole affixed to said bed frame with a attachment hole secured to said bed frames which signify the reciprocation of said bed frames on said tracks located on said center sectional frame;

a plurality of u-bolts or forward-reverse gear motors components interchangeably affixed to said pre-drilled mounting plates on said top sectional frames whereby operation individually or together of one component or up to five components per cycle of reciprocation enables a user to exercise multiple limbs and joints per cycle at approximately four cycles per minute when attached to a attachment belt, said belt is a component for moving the limbs, said belt is secured to said top sectional frame;

a plurality of stationary body supports affixed to a head and foot portion of said bed frames, said supports having adjustable extension supports that telescope within said stationary supports whereby said supports press against the head and feet of a user where said locking devices prevent a user from sliding in the direction of force being applied when the limbs of a user are lifted.

* * * * *